US005893288A

United States Patent [19]

Shore

[11] Patent Number: 5,893,288

[45] Date of Patent: Apr. 13, 1999

[54] MULTIPLE OUTLET FINISHING MILL

[75] Inventor: T. Michael Shore, Princeton, Mass.

[73] Assignee: Morgan Construction Company, Worcester, Mass.

[21] Appl. No.: 08/929,872

[22] Filed: Sep. 15, 1997

Related U.S. Application Data

[60] Provisional application No. 60/044,889, Apr. 25, 1997.

[51] Int. Cl.[6] ..... B21B 41/04; B21B 13/08

[52] U.S. Cl. ..... 72/228; 72/234

[58] Field of Search ..... 72/203, 204, 228, 72/226, 227, 238, 237, 239, 201, 202, 366.2, 200, 229

[56] References Cited

U.S. PATENT DOCUMENTS 3,129,617 4/1964 Schulte .

FOREIGN PATENT DOCUMENTS

0432532A2 6/1991 European Pat. Off. .
1071025 12/1959 Germany .
2160629 7/1972 Germany .
2553088A1 8/1976 Germany .
2722934A1 12/1978 Germany .
2738315A1 3/1979 Germany .
3602522A1 7/1987 Germany .
06285502 10/1994 Japan .
WO961417 5/1996 WIPO .

OTHER PUBLICATIONS

Patent Abstracts of Japan, vol. 095, No. 001, Feb. 28, 1995.

*Primary Examiner*—Joseph J. Hail, III
*Assistant Examiner*—Rodney Butler
*Attorney, Agent, or Firm*—Samuels, Gauthier & Stevens

[57] ABSTRACT

A billet is rolled in a rolling mill into a first process section in a succession of roll stands arranged along a first pass line. The first process section is either delivered as a finished product to a cooling bed or alternatively slit into second and third process sections which are subjected respectively to additional rolling in finishing blocks arranged on second and third pass lines parallel to the first pass line. At least one of the finishing blocks is shiftable onto the first pass line in order to subject the first process section to additional rolling prior to delivering it to the cooling bed.

6 Claims, 7 Drawing Sheets

MULTIPLE OUTLET FINISHING MILL

This application claims priority to provisional application Ser. No. 60/044,889 filed Apr. 25, 1997.

BACKGROUND OF INVENTION

1. Field of the Invention

This invention relates generally to rolling mills, and is concerned in particular with an improvement to the finishing section of a single strand bar mill.

2. Description of the Prior Art

The roll stands of conventional bar mills are usually aligned along a single pass line. Where slitting is being practiced, the roll stands of the roughing and intermediate mill sections are again aligned along a common pass line, with two sets of roll stands in the finishing section being aligned along parallel pass lines arranged to receive the slit sections. In both cases, the arrangement of the roll stands in the finishing section imposes severe limitations on the range of products the mill is able to produce.

SUMMARY OF THE INVENTION

The present invention is directed to a novel rearrangement of the roll stands of the finishing section to thereby broaden the range of products capable of being produced by the mill. In a first embodiment, the finishing section is provided with two laterally shiftable four stand finishing blocks. In one operational mode, the blocks are positioned on parallel pass lines arranged to roll slit strands into relatively low quality bar products, e.g. reinforcing bars. In another operational mode, the slitter is bypassed and one or the other of the finishing blocks is shifted onto the main pass line to roll high quality bar products from a single strand received directly from the intermediate mill section. In still another operational mode, the product exiting from one or the other finishing blocks is directed to an additional downstream block where it is rolled into rod.

In a second embodiment, each of the laterally shiftable blocks is further subdivided into two laterally shiftable two stand blocks, and in a third embodiment two stationary two stand blocks and a rod finishing block are arranged in a staggered relationship on three parallel pass lines.

DETAILED DESCRIPTION OF PREFERRED EMBODIMENTS

Figure 1A:
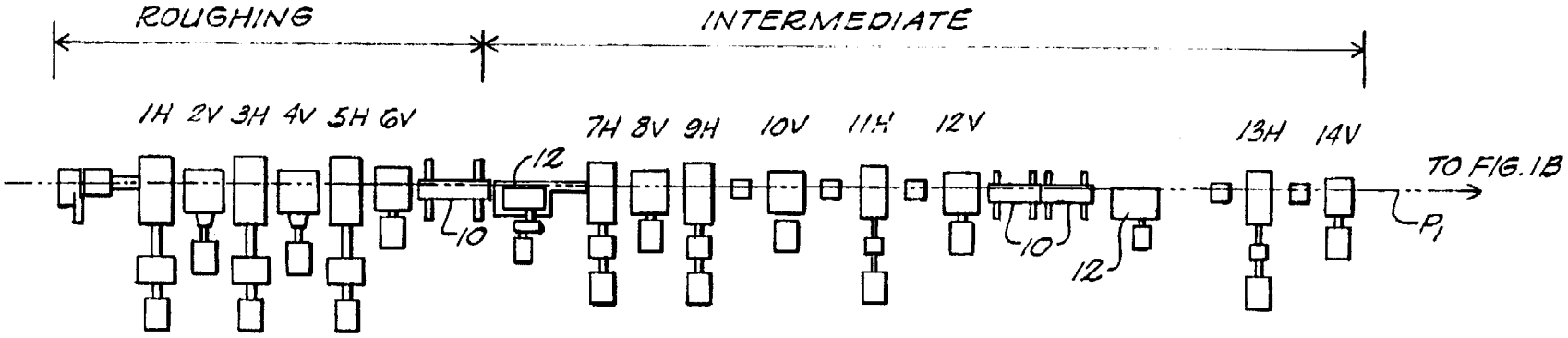
FIG. 1A is a schematic plan view of the roughing and intermediate sections of a single strand bar mill.
Figure 1B:
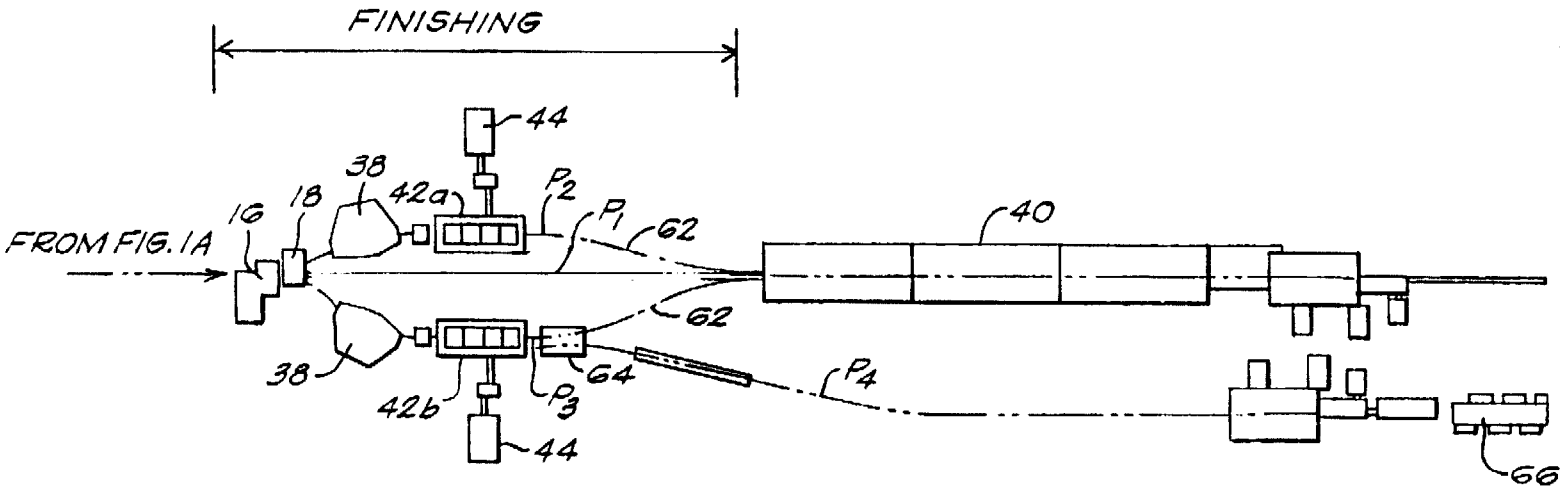
FIG. 1B is a schematic plan view of the finishing section of the same bar mill, with finishing blocks and downstream product handling equipment arranged in accordance with one embodiment of the present invention.

Referring initially to FIGS. 1A and 1B, a single strand bar mill in accordance with the present invention is shown comprising roughing, intermediate and finishing sections. The roughing section includes roll stands 1H, 2V, 3H, 4V, 5H and 6V aligned along the main mill pass line $P_1$. The intermediate mill section likewise includes roll stands 7H, 8V, 9H, 10V, 11H, 12V, 13H and 14V aligned along the same pass line. Other components typically associated with the roughing and intermediate sections of the mill include water boxes 10 and shears 12. Billets enter roll stand 1H and proceed through the roughing and intermediate sections of the mill from left to right as viewed in FIG. 1A. Upon exiting from the intermediate section of the mill, the resulting single strand process section immediately enters the finishing section of the mill. This section includes a slitter 16 and a switch 18. A better illustration of these components is provided by FIG. 2A, where it will be seen that the slitter 16 is mounted on a laterally traversable bed 20 along with a guide trough 22. The switch 18 includes two laterally traversable beds 24, 26. Bed 24 carries two angularly disposed guide troughs 28 and another guide trough 30 parallel to the main pass line $P_1$. Bed 26 carries further angular guide extensions 32 and an additional straight guide trough 34.

Figure 2A:
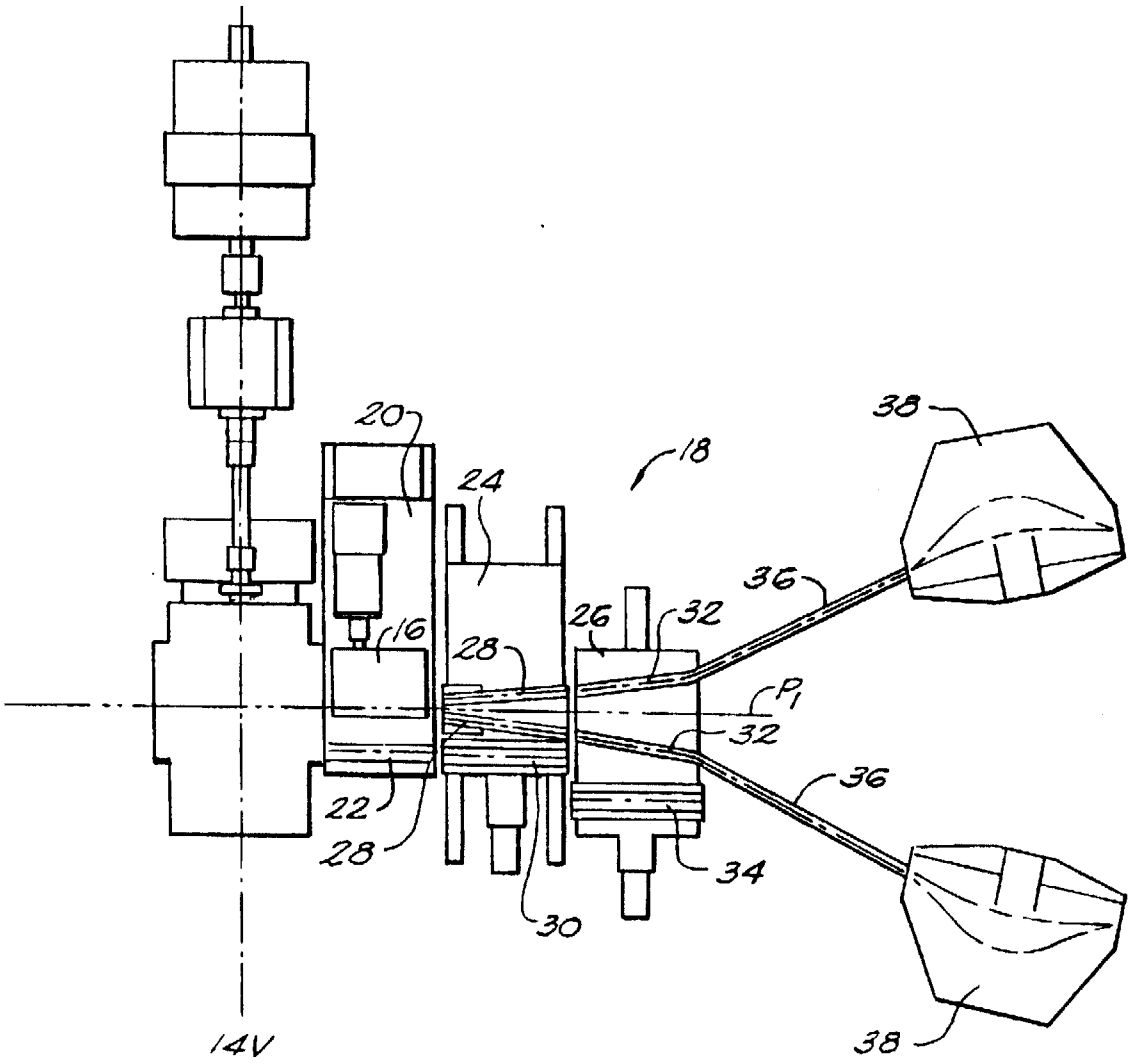
FIG. 2A is an enlarged plan view of the slitting and associated switching components of FIG. 1B shown in one operational mode.

In the operational mode depicted in FIG. 2A, the slitter 16, guide troughs 28 and their extensions 32 are positioned on the main pass line $P_1$. Thus, the first process section received from vertical stand 14V will be subdivided into second and third process sections by the slitter 16, and each of these subdivided process sections will be directed by guide troughs 28 and their extensions 32 to angularly disposed guide pipes 36 leading to side loopers 38. Side loopers are well known devices designed to accommodate the formation of horizontal loops in the product, which serve to relieve tension in the product as it passes from one roll pass to the next.

Figure 2B:
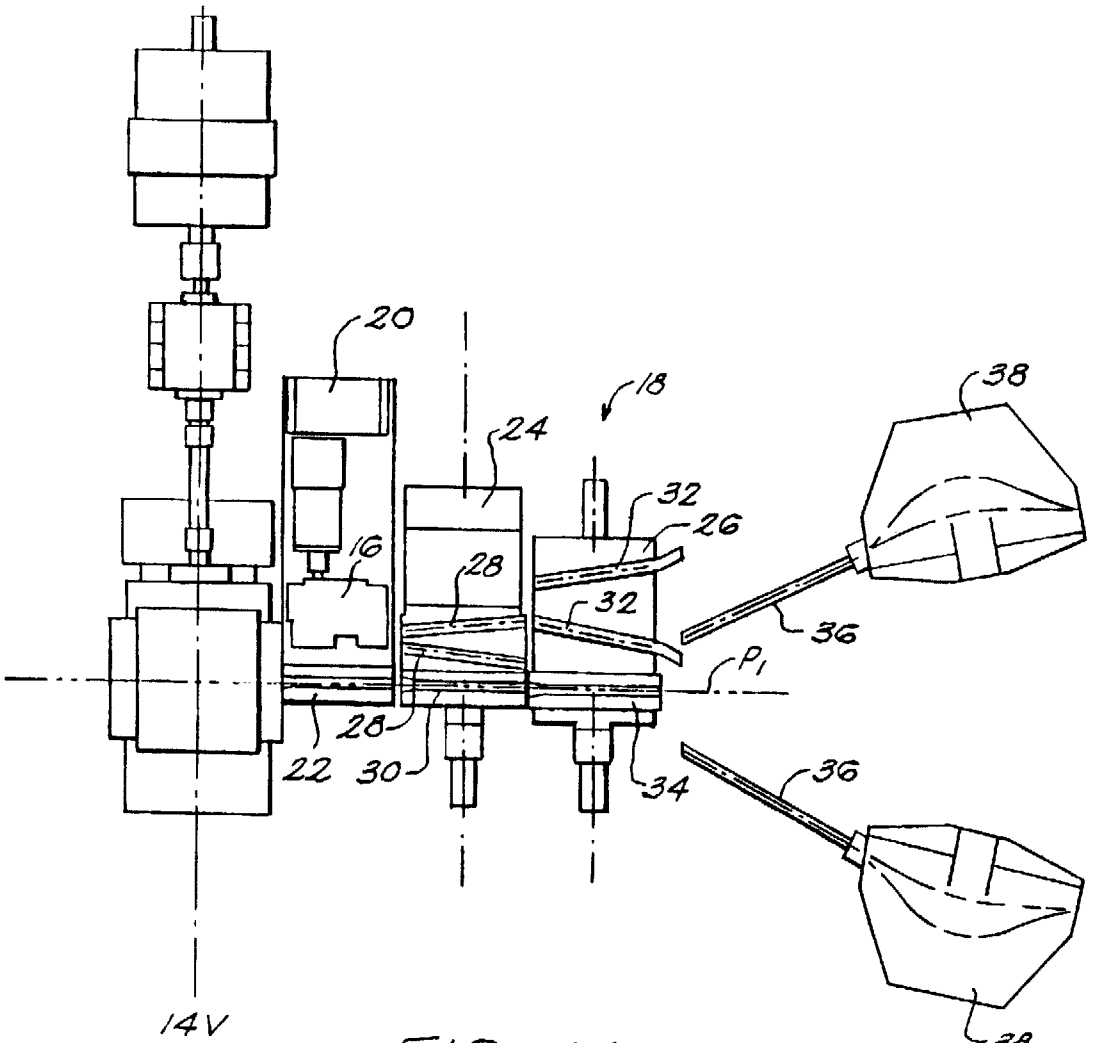
FIG. 2B is a view similar to FIG. 2A showing the slitting and switching components in another operational mode.

In the operational mode shown in FIG. 2B, the beds 20, 24 and 26 have been shifted to displace the slitter 16 to an inoperative position and to place the guide troughs 22, 30 and 34 in line with the main pass line $P_1$. This allows the first process section exiting from vertical stand 14V to continue along the main pass line $P_1$.

With reference again to FIG. 1B, when the slitter 16 and switch components are adjusted to the positions shown in FIG. 2B, the product will continue along the main pass line $P_1$ to a cooling bed 40. On the other hand, when the slitter and associated switching components are adjusted to the positions shown in FIG. 2A, the subdivided second and third process sections will continue through the side loopers 38 to auxiliary pass lines $P_2$ and $P_3$ running parallel to the main pass line $P_1$. Finishing blocks $42_a$, $42_b$ are located within the finishing section of the mill. Each finishing block $42_a$, $42_b$ is shiftable from its respective auxiliary pass line $P_2$, $P_3$ onto the main pass line $P_1$.

Figure 3:
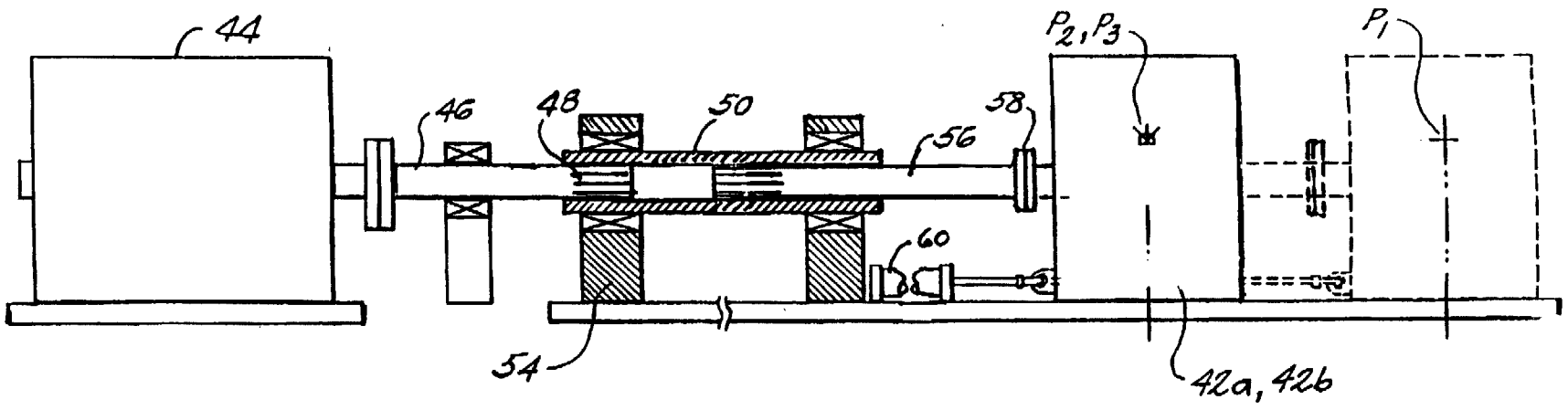
FIG. 3 is a partially sectioned view of a typical drive and shifting arrangement employed with either of the finishing blocks shown in FIG. 1B.

With reference to FIG. 3, which is typical of the drive and shifting arrangement for each finishing block, a drive motor 44 has an output shaft 46 with an externally splined end 48 received in an internally splined tube 50 rotatably supported by bearings 52 carried in a housing 54. A shaft 56 has an externally splined end received in the internally splined tube 50 and its opposite end connected by a coupling 58 to one or the other of the finishing blocks $42_a$, $42_b$. A pistoncylinder unit 60 serves as the mechanism for laterally shifting the associated finishing block between the main mill pass line $P_1$ and the respective auxiliary pass line $P_2$ or $P_3$.

When the finishing blocks $42_a$, $42_b$ are positioned as shown in FIG. 1B, products exiting therefrom are redirected by appropriate guides 62 back towards the main mill pass line $P_1$ where they continue along parallel paths to the cooling bed 40.

Optionally, one of the finishing blocks $42_a$, $42_b$ can feed a switch mechanism 64 which can be adjusted to divert the exiting product to a third path $P_4$ leading to a rod rolling block 66.

Figure 4A:
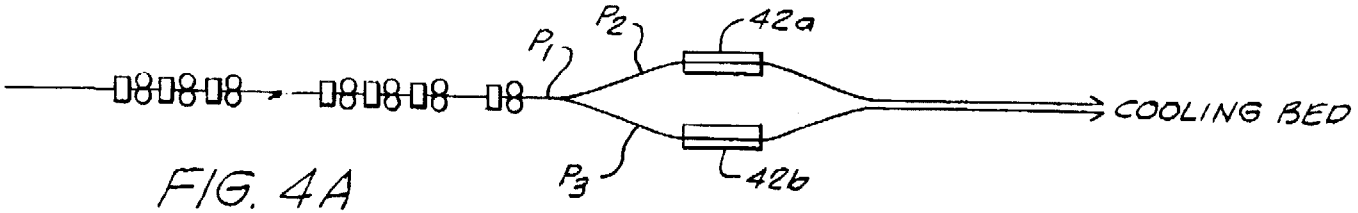
FIGS. 4A–4D are schematic illustrations depicting some of the rolling schedules possible with the finishing section shown in FIG. 1B.

FIG. 4A is a diagrammatic representation of the rolling of slit products into lower quality smaller diameter bars, such products being typically used as reinforcing bars in the construction industry.

Figure 4B:
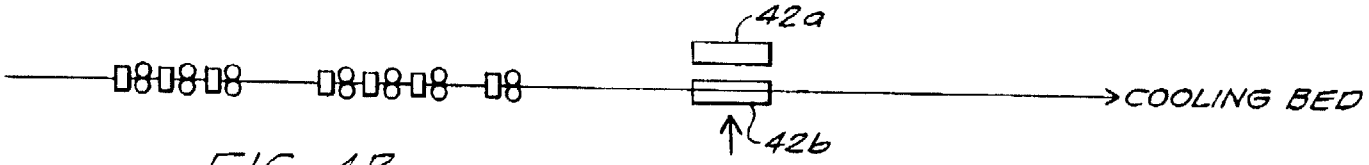

FIG. 4B illustrates the use of one of the finishing blocks $42_b$ to roll higher precision bars being received directly from the intermediate section of the mill.

Figure 4C:
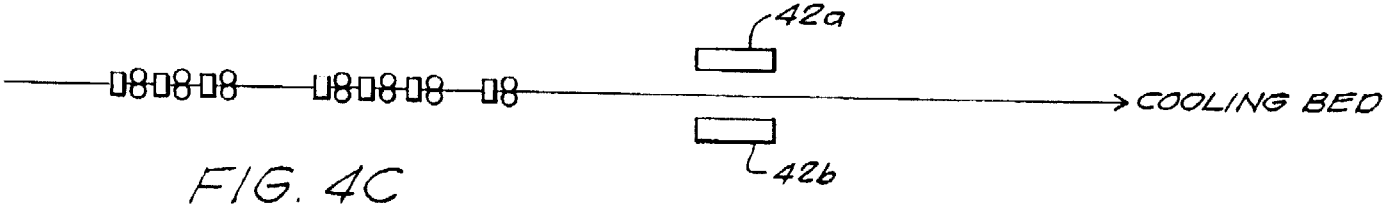

FIG. 4C illustrates another operational mode where both finishing blocks $42_a$, $42_b$ are bypassed and larger diameter bar products are directed from the intermediate section of the mill to the cooling bed.

Figure 4D:
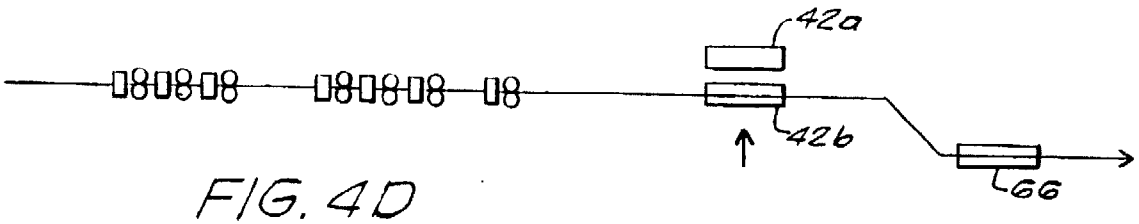

FIG. 4D illustrates still another operational mode where one of the finishing blocks $42_b$ is employed to roll product received directly from the intermediate section of the mill, and the product exiting from that finishing block is in turn diverted to the rod rolling block 66 for the production of high quality rods.

Figure 5:
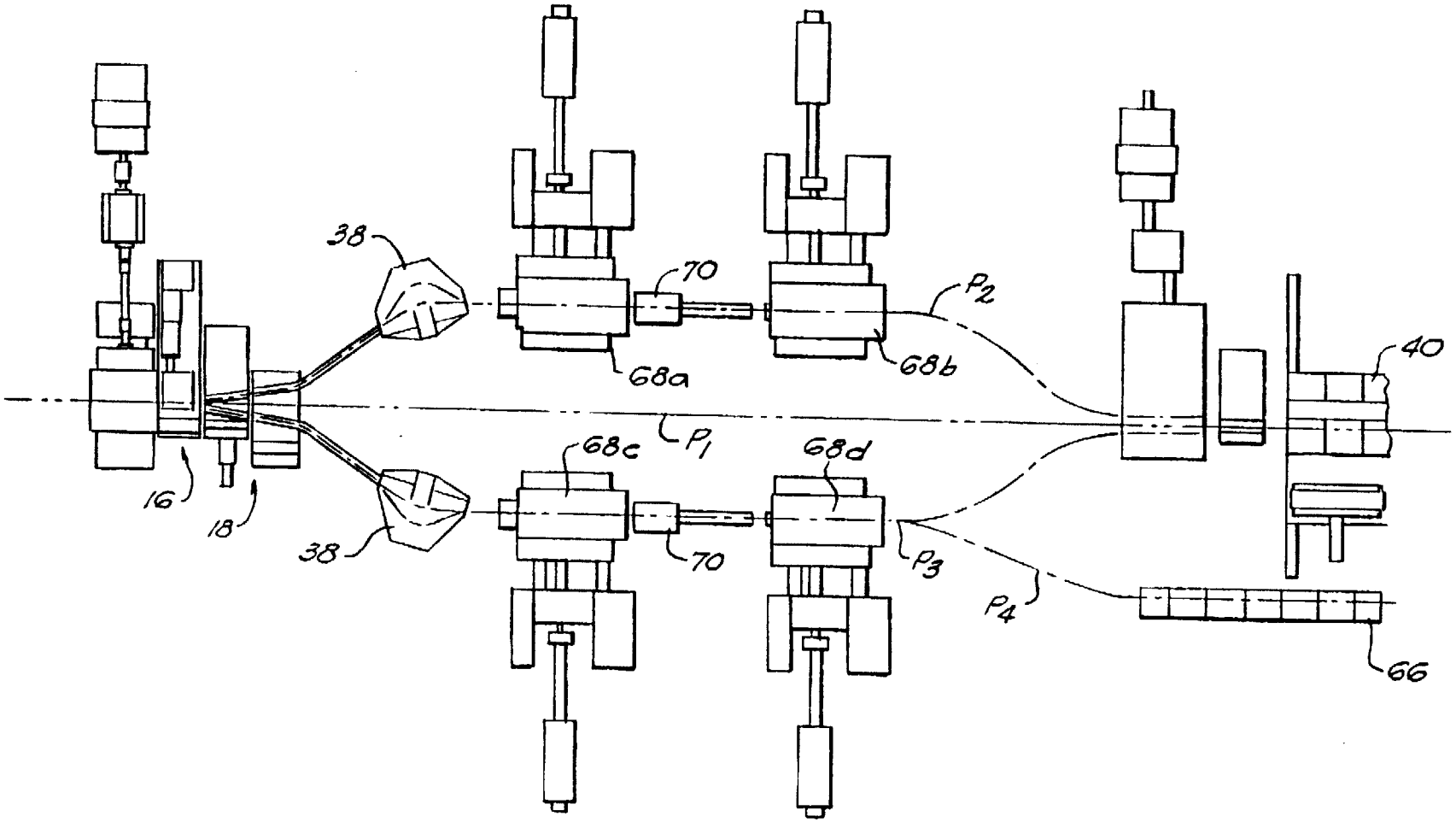
FIG. 5 is a plan view of an alternative embodiment of a finishing mill section with the components configured to roll two slit strands.

In FIG. 5, the parallel pass lines $P_2$, $P_3$ are occupied respectively by pairs of two stand blocks 68*a*, 68*b*, and 68*c*, 68*d*, with uploopers 70 between each pair of blocks. When the slitter 16 is operated to divide the product received from vertical stand 14V, the slit strands are again diverted by the switch 18 via side loopers 38 to the rolling lines $P_2$, $P_3$ where they are rolled through the respective pairs of blocks before being redirected centrally to the cooling bed 40. Optionally, the product emerging from block 68*d* can be switched to path $P_4$ for continued rolling in the rod rolling block 66.

Figure 6:
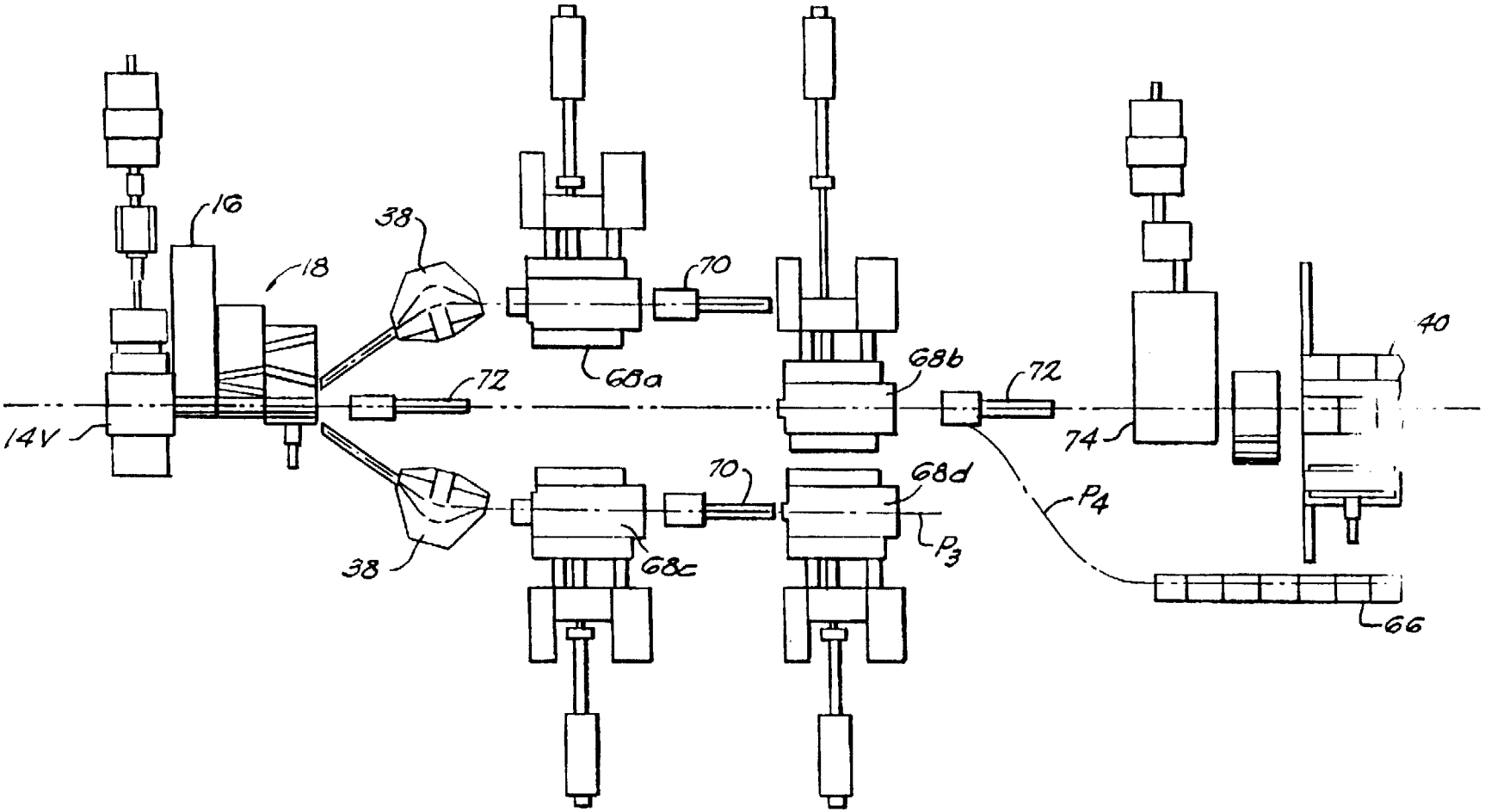
FIG. 6 is a view similar to FIG. 5, with the components reconfigured to roll a single strand product.

The same arrangement is depicted in FIG. 6 with the addition of uploopers 72 and a sizing mill 74 on pass line $P_1$. As herein employed, the term "uplooper" refers to a conventional apparatus designed to accommodate the controlled formation of a vertical loop in the product to thereby relieve tension which might otherwise develop in the product as it passes from one rolling block to the next. The term "sizing mill" refers to a block of stands in which successive roll passes take relatively light reductions, usually in a round-round sequence, as disclosed for example in U.S. Pat. No. 4,907,438. Here, the slitter 16 is inoperative, and the switch 18 is set to direct product along pass line $P_1$. One of the blocks 68*b* has been shifted onto pass line $P_1$ to finish roll the product prior to its being sized in mill 74. Alternatively, the product exiting from block 68*b* (or any of the other blocks 68*a*, 68*c* or 68*d* shifted onto pass line $P_1$) can be directed along path $P_4$ to the rod rolling block 66 or along path $P_1$ to bar sizing mill.

In light of the foregoing, it will now be appreciated by those skilled in the art that the present invention makes it possible to produce a wide range of products with a relatively modest outlay for capital equipment in the finishing section of the mill. This is due in large part to the use of laterally shiftable finishing blocks which can either be bypassed when rolling larger low quality bar, or used in tandem when rolling slit products, or employed alternatively when shifted onto the main rolling line to finish roll higher quality bars.

I claim:

1. A rolling mill comprising:

a plurality of roll stands arranged successively along a first pass line for rolling a billet into a first process section;

a cooling bed;

first guide means for directing said first process section along said first pass line for delivery to said cooling bed;

finishing blocks arranged on second and third pass lines parallel to said first pass line;

slitting means for subdividing said first process section into second and third process sections;

second guide means for directing said second and third process sections respectively to said second and third pass lines for continued rolling in said finishing blocks into products delivered to said cooling bed; and means for shifting at least one of said finishing blocks onto said first pass line for additional rolling of said first process section prior to delivery thereof to said cooling bed.

2. The rolling mill as claimed in claim 1 wherein said slitting means and said second guide means are shiftable between inoperative positions located laterally of said first pass line, and operative positions on said first pass line.

3. The rolling mill as claimed in claim 1 further comprising a rod rolling block, and third guide means for directing the product emerging from one of said finishing blocks to said rod rolling block.

4. The rolling mill as claimed in claim 2 wherein said first guide means is shiftable between an inoperative located laterally of said first pass line, and an operative position on said first pass line when said slitting means and said second guide means are shifted to their respective inoperative positions.

5. In a rod rolling mill wherein a billet is rolled into a first process section in a succession of roll stands arranged along a first pass line, and said first process section is either delivered to a cooling bed or alternatively slit into second and third process sections which are subjected respectively to additional rolling in finishing blocks arranged on second and third pass lines parallel to said first pass line, the improvement comprising shifting one of said finishing blocks onto said first pass line, and subjecting said first process section to additional rolling in the thus shifted finishing block prior to delivering the same to said cooling bed.

6. A method of rolling long products, comprising:

rolling a billet into a first process section in a succession of roll stands arranged along a first pass line and (a) directing said first process section to a cooling bed;

(b) as an alternative to (a);

(i) slitting said first process section into second and third process sections;

(ii) rolling said second and third process sections into products in finishing blocks arranged on second and third pass lines parallel to said first pass line; and (iii) directing the products emerging from said finishing blocks to said cooling bed; and (c) as an alternative to (a) or (b)

(i) shifting one of said finishing blocks to said first pass line; and (ii) continuing the rolling of said first process section in the thus shifted finishing block before directing the product emerging therefrom to said cooling bed.

* * * * *